US008594353B2

(12) United States Patent
Anderson

(10) Patent No.: US 8,594,353 B2
(45) **Date of Patent: *Nov. 26, 2013**

(54) HEARING AID WITH OCCLUSION SUPPRESSION AND SUBSONIC ENERGY CONTROL

(75) Inventor: James Robert Anderson, Chicago, IL (US)

(73) Assignee: GN ReSound A/S, Ballerup (DK)

( * ) Notice: Subject to any disclaimer, the term of this patent is extended or adjusted under 35 U.S.C. 154(b) by 117 days.

This patent is subject to a terminal disclaimer.

(21) Appl. No.: 13/241,035

(22) Filed: Sep. 22, 2011

(65) Prior Publication Data

US 2012/0076334 A1 Mar. 29, 2012

Related U.S. Application Data

(63) Continuation-in-part of application No. 13/022,428, filed on Feb. 7, 2011, now Pat. No. 8,494,201.

(30) Foreign Application Priority Data

Sep. 22, 2010 (EP) ..... 10178256

(51) Int. Cl.
*H04R 25/00* (2006.01)

(52) U.S. Cl.
USPC ..... 381/317; 381/312; 381/318

(58) Field of Classification Search
USPC ..... 381/312–313, 316–318, 320–321, 322, 381/328
See application file for complete search history.

(56) References Cited

U.S. PATENT DOCUMENTS

| | | | |
|---|---|---|---|
| 4,985,925 | A | 1/1991 | Langberg et al. |
| 6,937,738 | B2 | 8/2005 | Armstrong et al. |
| 8,116,489 | B2 | 2/2012 | Mejia et al. |
| 2003/0012391 | A1 | 1/2003 | Armstrong et al. |
| 2003/0053647 | A1 | 3/2003 | Kates |
| 2008/0063228 | A1 | 3/2008 | Mejia et al. |
| 2009/0310805 | A1 | 12/2009 | Petroff |
| 2010/0220881 | A1 | 9/2010 | Arndt et al. |

FOREIGN PATENT DOCUMENTS

| | | |
|---|---|---|
| EP | 1129600 | 9/1998 |
| EP | 2309778 | 4/2011 |

(Continued)

OTHER PUBLICATIONS

Non-final Office Action dated Oct. 11, 2012, for U.S. Appl. No. 13/022,428.

(Continued)

*Primary Examiner* — Suhan Ni
(74) *Attorney, Agent, or Firm* — Vista IP Law Group, LLP

(57) ABSTRACT

A hearing aid includes an ambient microphone configured to receive and convert environmental sound into an electronic input signal, a hearing loss processor configured to compensate the electronic input signal in accordance with a hearing loss of a user of the hearing aid, and to generate an electronic output signal, a receiver, an ear canal microphone configured for converting ear canal sound pressure including subsonic energy into an ear canal signal, an occlusion suppressor connected for reception and processing of the ear canal signal, and for transmitting an occlusion suppression signal, a signal combiner configured for combining the occlusion suppression signal and the electronic output signal to form a combined signal, and for transmitting the combined signal to the receiver, and a subsonic filter for filtering subsonic energy, wherein the receiver is configured to receive the combined signal, and convert the combined signal into an acoustic output signal.

23 Claims, 12 Drawing Sheets

(56) References Cited

FOREIGN PATENT DOCUMENTS

| | | | |
|---|---|---|---|
| WO | 00 28784 | A1 | 5/2000 |
| WO | 2004/021740 | A1 | 3/2004 |
| WO | 2006/037156 | A1 | 4/2006 |
| WO | 2008/043792 | A1 | 4/2008 |
| WO | 2008/043793 | A1 | 4/2008 |

OTHER PUBLICATIONS

Jorge Mejia et al., "Active Cancellation of Occlusion: An electronic vent for hearing aids and hearing protectors", Journal of the Acoustical Society of America Published for the Acoustical Society of America through the American Institute of Physics USA, Jul. 2008, pp. 235-240, vol. 124, Australia.

Technical Survey Report, Apr. 28, 2009, PRV InterPat, Stockholm, Sweden.

Extended European Search Report for EP Application No. 10178256.3.

Jorge Mejia et al., "The Occlusion Effect and Its Reduction", 1st International Symposium on Auditory and Audiological Research, 2007, pp. 459-470, Australia.

European Search Report mailed Dec. 12, 2011 for EP Application No. 11182286.2.

Notice of Allowance and Fees Due dated Mar. 15, 2013 for U.S. Appl. No. 13/022,428.

HEARING AID WITH OCCLUSION SUPPRESSION AND SUBSONIC ENERGY CONTROL

RELATED APPLICATION DATA

This application claims priority to, and the benefit of, European Patent Application No. 10178256.3, filed on Sep. 22, 2010, and is a continuation-in-part of U.S. patent application Ser. No. 13/022,428, filed on Feb. 7, 2011, the entire disclosure of which is expressly incorporated by reference herein.

FIELD

The present application relates to a hearing aid which comprises an occlusion suppression system, a receiver with extended low frequency response or static pressure capability and defined subsonic filtering to reduce undesirable effects due to large amounts of subsonic energy produced primarily by jaw motion which may exist in the frequency region below 10Hz and improve suppression of occlusion signals in a hearing aid user's ear canal.

BACKGROUND

The primary objective of a hearing aid is to compensate for a user's hearing loss by amplifying and otherwise processing environmental sound received at an outwardly placed or ambient microphone of the hearing aid. Amplified or processed sound is emitted to the user's fully or partially occluded ear canal through a suitable miniature loudspeaker or receiver in a manner where at least partial compensation of the user's specific hearing loss is accomplished.

However, mounting an ear mould or housing of the hearing aid in the user's ear canal introduces new imperfections. One such imperfection is occlusion, which is a phenomenon caused by full or partial physical blocking of the user's ear canal. The hearing aid user experiences occlusion as an unnatural exaggerated perception of low frequency components of his/hers own voice as well as excessive perception of jaw and mouth sounds which are conducted directly through bone and tissue of the user. Occlusion perception generally increases the more the hearing aid housing or ear mould blocks the ear canal and may vary between different styles of hearing aids such as in-the-ear (ITE), completely-in-the-canal (CIC) and behind the ear (BTE) and different characteristics of an ear mould.

The effect of occlusion and occlusion suppression on a hearing aid user is explained shortly below in a simplified situation in which the only sound sources considered are the receiver and the body conducted sound. In this simplified case of sound emission from a hearing aid, sound heard by the user will be a combination of a perceived or excess body conducted sound ($B_P$=B−B'), and a receiver emitted sound (R), whereas a microphone in the ear canal would observe E=R+B=R+B'+$B_P$, i.e. including the unnoticed or reference sound B'.

To give a hearing aid user an experience of unoccluded hearing, a ratio between body conducted sound and receiver generated or emitted sound must correspond to the ratio between body conducted sound and ear canal conducted sound for an unoccluded ear. If it was possible to isolate the perceived body conducted sound ($B_P$), this sound could be emitted in opposite phase in the user's ear canal, with the effect of a perfect cancellation of the excess part of body conducted sound, thus resulting in a perfect cancellation of occlusion sensation. However, in practice it is not possible to isolate the body conducted sound, and even less the perceived (i.e. "excess") body conducted sound, but an ear canal microphone may be used to register the combination of body conducted sound and receiver emitted sound (E=R+B).

Assuming two receivers were placed in the hearing aid user's ear canal, one receiver could emit the ambient sound with an appropriate gain g ($R_1$=g*A), and the other could subtract (i.e. emit in opposing phase) the registered ear canal sound with an appropriate gain f ($R_2$=f*E=f*($R_1$+$R_2$+B)=f*(g*A+$R_2$+B) or $R_2$=f(g*A+B)/(1−f)), resulting in a perceived ear sound:

(E=$R_1$+B'+$B_P$−$R_2$)=g*A+B−f(g*A+B)/(1−f)=(1−(f/(1−f))*(g*A)+B)).

The occlusion suppression task then becomes to balance f and g, such that the sound heard by the user has the same ratio of body conducted sound to receiver emitted sound as the ratio between body conducted sound and ear canal conducted sound for an unoccluded ear. While this suppression task may appear simple, in practice it will involve a rather complex and calculation intensive optimization, which may not be desirable to perform in practice with current calculation power of Digital Signal Processors for hearing aids, especially considering the simplifications in the above explanation.

The practical implementation of an occlusion suppressor will typically not involve the use of two receivers, but rather be implemented in a device configured for subtraction of an electrical signal prior to output amplification, as will be familiar to the person skilled in the art.

The latter implementation will require an occlusion suppressor configured for processing the ear canal sound or sound pressure such that the after amplification the sum of the signal from a hearing loss compensation means and the occlusion suppressor will suppress the perceived body conducted sound, such that when the hearing aid is in normal operation, the user will perceive only the hearing loss compensated signal, without a perceived body conducted sound.

Hearing aid occlusion has mainly been combated or suppressed by two methods; passive acoustical venting, and more recently, by signal processing. Venting may be implemented either as an acoustical vent comprising acoustical channels or conduits extending through the hearing aid housing or extending through the ear mould. Venting may alternatively be implemented as a so-called "open fitting" hearing aid with a loose fit in the user's ear. Both methods can be effective in reducing the user's perception of occlusion by allowing low frequency sound in the ear canal to escape to the surrounding environment through the vent. Venting to the extent required to be effective in reducing occlusion is, however, accompanied by two significant adverse effects:

1) A suppression or attenuation of low frequency sound generated by the hearing aid;
2) An increased risk of acoustical feedback and hearing aid instability because of acoustical leakage through the vent to an ambient microphone(s) of the hearing aid.

With respect to effect 1), low frequency components of the receiver sound is reduced by the same amount as the reduction in the occlusion level causing a reduction of both available low frequency gain and maximum undistorted output from the hearing aid at low frequencies. Since the individuals most affected by occlusion have mild loss to normal hearing at low frequencies, and thus don't need much, if any, gain for low frequencies, this might not necessarily be a problem in itself, but since the occlusion levels experienced are often of a high amplitude, even a person with a severe low frequency sensorineural loss may be bothered by the occlusion effect, but simultaneously need significant low frequency gain.

With respect to effect 2), venting often leads to a requirement for feedback cancellation or suppression system to obtain a prescribed or target hearing aid gain. Feedback cancellation systems are accompanied by their own range of limitations and problems. Also, venting can give unpredictable results, sometimes producing much less occlusion reduction than expected. A vent with its cut off frequency situated in the vicinity of a fundamental frequency of the users own voice will likely make the occlusion effect worse.

More recently, signal processing has been used in suppression of occlusion in hearing aids, such as that described in U.S. Pat. No. 4,985,925. More recent publications specifically implementing signal processing based or active suppression of occlusion include EP 1 129 600, WO 2006/037156, WO 2008/043792, U.S. Pat. No. 6,937,738, U.S. Pat. No. 2008/0,063,228, WO 2008/043793, EP 2 309 778, Mejia, Jorge et al., "The occlusion effect and its reduction", Auditory signal processing in hearing-impaired listeners, 1st International Symposium on Auditory and Audiological Research (ISAAR 2007), ISBN: 87-990013-1-4, and Meija, Jorge et al., "Active cancellation of occlusion: An electronic vent for hearing aids and hearing protectors", J. Acoust. Soc. Am. 124(1), 2008.

Common for these approaches is that, an "ambient sound" received at the ambient microphone, is processed by a hearing loss processor to compensate for the hearing loss of a user to generate a desired sound, is combined with an compensation signal captured by a microphone in the user's partly or fully occluded ear canal volume in such a way that the sum of these signals suppresses the perceived excess body conducted sound.

While these approaches may be improvements over the previous approaches, they also suffer from drawbacks, such as artefact sounds due to an unstable feedback loop or overload of an output amplifier or receiver enclosed in the feedback loop.

A particularly severe problem not addressed before is caused by high amplitude subsonic signals in the residual volume of the occluded ear canal primarily due to jaw motion. Jaw motion changes the shape and thus volume of the residual volume of the ear canal, generating undesirable subsonic pressure signals that can have extremely high amplitudes. These signals may overload the output amplifier or receiver as the feedback loop attempts to cancel them, creating audible artefacts, and wasted battery energy. Even if overload does not occur, these large signals waste the dynamic range of the output amplifier and receiver that are needed for effective occlusion cancellation.

One object of one or more embodiments described herein is to reduce the effects of the aforementioned subsonic signals.

The presence of these extremely high amplitude subsonic signals has not been dealt with in a satisfying way. In WO 2006/037156 and U.S. Pat No. 2008/0,063,228, a conventional vent is shown to be optional "to depressurise the ear thus reducing the sensation of stuffiness in the ear.

Meija, Jorge et al., "Active cancellation of occlusion: An electronic vent for hearing aids and hearing protectors", J. Acoust. Soc. Am. 124(1), 2008, proposes individualized transducer responses combined with closed loop prediction, which is cumbersome, expensive and/or difficult to implement in a hearing aid.

SUMMARY

The choice and design of receivers used for occlusion suppression hearing aids have been based on considerations related to hearing loss compensation. However, the present inventor has by a combination of experiments and circuit simulations demonstrated that utilizing a receiver with an extended low frequency response or static pressure capability plus defined subsonic filtering in an active occlusion suppressing hearing aid leads to a considerable improvement in its ability to reduce undesirable effects due to subsonic energy produced primarily by jaw motion. The present inventor has been first to identify that occlusion effects extend beyond the frequency range normally considered for amplification in connection with hearing loss compensation such as amplification between 200 Hz and 10 kHz. The present inventor has been first to include the subsonic frequency range, particularly below 10 Hz, in the design of active occlusion suppressing hearing aids.

According to a first aspect, there is provided a hearing aid comprising an ambient microphone adapted to receive and convert environmental sound into an electronic input signal. A hearing loss processor is adapted to compensate the electronic input signal in accordance with a hearing loss of the user and generate an electronic output signal. A receiver is adapted to receive and convert a combined signal into an acoustic output signal and an ear canal microphone adapted to convert ear canal sound pressure into an ear canal signal. An occlusion suppressor is connected for reception and processing of the ear canal signal and for transmitting an occlusion suppression signal to a signal combiner combining the occlusion suppression signal and the electronic output signal. The combined signal is transmitted to the receiver. In accordance with some embodiments, a lower cut-off frequency of a frequency response of the receiver is in an embodiment less than 10 Hz, in an further embodiment less than 1 Hz, and in yet another embodiment, the receiver is substantially capable of holding a static pressure into a sealed volume, and having a rear cavity pressure equalization path to atmospheric pressure.

In the present context, the lower cut-off frequency of the frequency response of the receiver is measured by coupling the receiver to an IEC 711 Ear Simulator or coupler via 10 mm of Ø 1 mm tubing. The lower cut-off frequency is a frequency, in a frequency range below 1 kHz, where the sound pressure level is 3 dB lower than a sound pressure level at 1 kHz. The receiver may comprise a miniature electro-dynamic or moving coil loudspeaker or a miniature balanced armature receiver such as a Knowles FH 3375 hearing aid receiver. A suitable receiver with extended low frequency response so as to comply with the above-referenced range of lower cut-off frequencies can be manufactured by reducing a size of a barometric pressure relief hole placed in a diaphragm of a standard balanced armature receiver.

Alternatively, the barometric relief hole may be removed from the diaphragm creating the "static pressure capability" mentioned above and a hole, vent or acoustic channel of suitable dimensions placed through a rear chamber casing of the receiver and having a path to atmospheric pressure hereafter referred to as "rear chamber equalization". From this point forward, it is assumed that the use of "static pressure capability" implies and includes the additional use of "rear chamber equalization" as it may be impractical to operate without it.

Experimental tests and circuit simulations conducted by the inventor have revealed that a receiver with extended low frequency response or static pressure capability as stated above and combined with an appropriately defined subsonic filtering scheme, for example provided a subsonic filter, is highly beneficial in improving the performance of an active occlusion suppression system in hearing aids or instruments.

The inventor has experimentally identified a number of occlusion sound pressure sources, such as jaw motions of the user, which create surprisingly large ear canal sound pressures within the fully or partly sealed ear canal at very low frequencies (including sound at subsonic frequencies below 10 Hz). In hearing aids with active occlusion suppression, these large sound pressure levels at subsonic frequencies have not been adequately addressed and are often accompanied by sound artefacts such as popping or clicking. A feedback loop through the occlusion suppressor to the signal combiner generates high amplitude drive to the receiver in seeking to cancel the above-mentioned large subsonic sound pressure levels within the user's ear canal. The above-mentioned sound artefacts are created by overloading or saturating an output stage amplifier and/or the receiver itself. The large amount of loop gain ~15-20 dB maximum, causes the loop to generate high amplitude drive to the receiver to cancel large signals. During an attempt to substantially cancel a signal, the receiver needs to output a signal nearly the same amplitude (but of opposite phase) as the signal to be cancelled. If the receiver is called upon to cancel a signal which is larger than the receiver can produce, the receiver and or output amplifier will saturate, creating failure to fully cancel the signal as well as potentially severe distortion, which is unacceptable.

By using the above-specified receiver with extended low frequency response or static pressure capability plus, where the above mentioned defined subsonic filtering scheme comprises a combination of an appropriately sized acoustical vent (chosen to achieve maximum subsonic attenuation (maximized low frequency cut-off frequency) while avoiding excessive reduction of low speech frequency receiver maximum output capability and therefore not having a low frequency cut-off greater than approximately 200-300 Hz), and additional low frequency roll off in the closed acoustic feedback loop (since the subsonic attenuation of the vent by itself is necessary but insufficient), the present hearing aid is capable of occlusion cancellation significantly free of artefacts caused by large sound pressure levels at subsonic frequencies such as jaw motion induced subsonics without overloading or dominating the dynamic range of the output stage amplifier and/or the receiver itself so as to provide effective cancellation of low frequency occlusion sound pressure levels without audible sound artefacts or wasted battery energy.

The present hearing aid may be embodied as an in-the-ear (ITE), in-the-canal (ITC), or completely-in-the-canal (CIC) aid with a housing or housing portion shaped and sized to fit the user's ear canal. The housing is in an embodiment enclosing the ambient microphone, hearing loss processor, occlusion suppressor, ear canal microphone and the receiver inside an optimally vented customized hard or soft shell of the housing. Alternatively, the present hearing aid may be embodied as a receiver-in-the-ear BTE or traditional behind-the-ear (BTE) aid comprising an optimally vented ear mould for insertion into the user's canal. The BTE aid may comprise a flexible sound tube adapted for transmitting sound pressure generated by a receiver placed within a housing of the BTE aid to the user's ear canal. In this embodiment, the ear canal microphone may be arranged in the ear mould while the ambient microphone, hearing loss processor, occlusion suppressor and the receiver are located inside the BTE housing. The ear canal signal may be transmitted to the occlusion suppressor through a suitable electrical cable or another wired or unwired communication channel.

The ambient microphone may be positioned inside the hearing aid housing for example close to a faceplate of an ITE or CIC hearing aid housing. The microphone may alternatively be physically separate from the hearing aid housing and coupled to the hearing loss processor by a wired or wireless communication link.

The ear canal microphone has in an embodiment a sound inlet positioned at a tip portion of the ITE, ITC or CIC hearing aid housing or tip of the ear mould of the BTE hearing aid allowing unhindered sensing of the ear canal sound pressure within the fully or partly occluded ear canal volume residing in front of the user's tympanic membrane or ear drum.

The signal combiner may comprise a subtraction circuit or subtraction function implemented in analog format or digitally to subtract the occlusion suppression signal from the electronic output signal to establish a feedback path around the receiver and an output amplifier of the hearing aid. The occlusion suppression signal is in an embodiment derived from the feedback path of the occlusion suppressor with the result that both occlusion sound pressure, generated by body conduction, and low-frequency components representing the intended signal from the hearing loss processor of the acoustic output signal of the receiver are attenuated by approximately similar amounts.

The hearing loss processor may comprise a programmable low power microprocessor such as a programmable Digital Signal Processor executing a predetermined set of program instructions to amplify and process the electronic input signal in accordance with the hearing loss of the user and generate an appropriate electronic output signal. Alternatively, the hearing loss processor may comprise a processor based on hard-wired arithmetic and logic circuitry configured to perform a corresponding amplification and processing of the electronic input signal. In these embodiments, the electronic input signal is provided as digital signal provided by an A/D-converter that may be integrated with the hearing loss processor or arranged in a housing of the ambient microphone.

The occlusion suppressor may be implemented in various technologies or formats for example analog, digital or a combination thereof. In one fully digital embodiment, the occlusion suppressor comprises a predetermined set of program instructions executed on the above-mentioned programmable Digital Signal Processor of the hearing loss processor. In this embodiment, a single DSP may be utilized for implementing both the hearing loss processor and the occlusion suppressor leading to hardware savings. In another embodiment, the occlusion suppressor comprises a hard-wired arithmetic and logic circuit block configured to provide the processing of the ear canal signal and transmittal of the occlusion suppression signal to the signal combiner. The occlusion suppressor may be integrated with the hearing loss processor on a common semiconductor substrate or provided as a separate digital circuit.

The ear canal microphone has in an embodiment a sound inlet positioned at a tip portion of the hearing aid housing or tip of the ear mould allowing essentially unobstructed sensing of sound pressure inside an ear canal volume residing in front of the user's tympanic membrane or ear drum.

According to some embodiments, the receiver comprises a diaphragm hole and/or a rear chamber vent setting the lower cut-off frequency of the frequency response of the receiver. In an embodiment, the diaphragm lacks the diaphragm hole or barometric pressure relief hole and the receiver is substantially capable of holding a static pressure into a sealed volume, and having a rear cavity pressure equalization path to atmospheric pressure to allow the rear cavity to follow atmospheric pressure changes so that the diaphragm may center itself. A significant advantage of the latter embodiment is that it allows boosting of the frequency response of the receiver at low frequencies near and below a predetermined frequency hereafter referred to as a "receiver shelf frequency". In an embodiment, the receiver shelf frequency is greater than 10 Hz. In a further embodiment, the receiver shelf frequency is less than 10 Hz. In a further embodiment, the receiver shelf frequency is between 10 and 500 Hz. In yet a further embodiment, the receiver shelf frequency is between 20 and 200 Hz. In an additional further embodiment, the receiver shelf frequency is between 50 and 100 Hz. The receiver shelf frequency may be determined by characteristics of the rear chamber vent and other characteristics of the receiver, essentially generating a shelf type response hereafter referred to as a "receiver shelf response" characteristic, which shows a boost of the lowest frequencies compared to the higher frequencies where no boost occurs. The boosting of the frequency response near and below the receiver shelf frequency may increase low frequency output capability of the receiver, and provides a more favourable phase response in the form of a dip or reduction of receiver phase response in the vicinity of the receiver shelf frequency. The more favourable phase response may help to reduce the low frequency peaking of the closed acoustic feedback loop, hereafter referred to simply as "low frequency peaking" that may likely occur in the 10 to 100 Hz region. This low frequency peaking is the natural result of the choices of low frequency roll-offs in the feedback loop of at least one embodiment needed to achieve sufficient subsonic signal reduction at the receiver terminals. While this peaking is not a desirable characteristic, it is a necessary trade-off with the subsonic jaw motion problem, which has been determined by experiment to be the more serious problem.

Alternatively, if a conventional receiver which does not have a receiver shelf frequency is used, an alternative embodiment may include a shelf response having a shelf frequency incorporated into the loop filter of the acoustic feedback loop to achieve a similar effect on the low frequency peaking. However, the benefit of increased low frequency receiver output capability is not obtained, and subsonic receiver drive will be increased by the magnitude of the shelf response employed, so this is not a desirable embodiment, since it aggravates the subsonic energy problem.

In other embodiments, the receiver lacks the rear chamber vent and the lower cut-off frequency is instead mainly determined by dimensions of the diaphragm hole that may have smaller dimensions than a diaphragm hole in a standard receiver.

According to some embodiments, an acoustical vent is extending through or around the housing or the ear mould of the hearing aid. The acoustical vent may have a high pass cut-off frequency which in one embodiment is between 100 Hz and 500 Hz, and in another embodiment between 200 Hz and 300 Hz. The acoustical vent may comprise one or more acoustical channels or conduits establishing an acoustical connection between the ear canal volume residing in front of the user's ear drum and the surrounding environment. The acoustical vent allows low frequency sound to propagate from the ear canal volume to the surrounding environment and vice versa. The acoustical vent will therefore contribute as a high pass filter to a frequency response of the hearing aid. The high pass cut-off frequency of this high pass filter will depend on a shape and size of the acoustical vent. In the present specification, the term "acoustical vent" covers both a specific physical channel, or channels, and an open or loose fit between user's ear canal and the hearing aid housing or ear mould creating an acoustical leakage path.

While optimum frequency response characteristics of an acoustic feedback loop which comprises the acoustical vent may be distributed in various ways amongst individual components and functions such as the ear canal microphone, the receiver, the occlusion suppressor, the combined signal, etc. there are significant advantages to setting the high pass cut-off frequency of the acoustical vent as a dominant low frequency cut-off of the acoustic feedback loop. Attempting to use the cut-off frequency of a standard receiver to roll of the subsonic loop gain rather than the vent is not beneficial because it does not reduce the amplitude of the occlusion pressure, and further, the ratio of occlusion pressure to maximum output capability of the receiver worsens. The high pass cut-off frequency of the acoustical vent is often the only function which passively reduces the amplitude of subsonic jaw motion related or generated components of the ear canal sound pressure. If chosen to be sufficiently high, the high pass cut-off frequency of the acoustical vent may ideally reduce the subsonic jaw motion generated components of the ear canal sound pressure to a level which does not need to be cancelled by the occlusion suppression system. However, this goal is not conveniently met without setting the vent cut-off frequency to an undesirably high frequency (potentially in the frequency range of 400 to 500 Hz or higher), such that desired speech or other desired low frequency audio band signals may suffer a lowered maximum output level and accompanying low frequency response deterioration. What is needed is an additional low frequency roll-off in the defined subsonic filtering to achieve the desired total subsonic attenuation, and this is a key component of an embodiment to be discussed below.

It was found that when attempting to find a vent size to provide an acceptable trade-off between 1) subsonic attenuation below 10 Hz (vent would need a low frequency cut-off greater than approximately 400 to 500 Hz), and 2) avoiding excessive reduction of low speech frequency maximum output capability (not greater than approximately 200-300 HZ), the goals cannot be simultaneously met. It was found that with a vent cut-off frequency in this 200 to 300 Hz range that approximately 20 dB of addition attenuation in the 5 Hz region is desirable to reach our subsonic attenuation goal.

A goal of our solution is more precisely defined as follows: When the acoustic feedback loop gain is set to provide approximately 20 dB of occlusion cancellation for the low speech frequency region, subsonic energy predominantly due to jaw motion should cause typical receiver drive levels to not exceed approximately −20 dB relative to full scale, and −10 dB worst case, to preserve the system dynamic range for the intended function of speech occlusion reduction. A later section explains how the necessary additional subsonic attenuation is provided to meet this goal.

At least one embodiment relieves the occlusion suppression system of the burden of processing or handling very high subsonic sound pressure imposed on the ear canal microphone and reduces the subsonic portion of the combined signal applied to the receiver to an acceptable level. Consequently, the very high subsonic sound pressure is prevented from impairing dynamic range of the occlusion suppression system for speech frequency occlusion cancellation. Furthermore, battery power or energy of a hearing aid battery is preserved by the suppression of the subsonic portion of the combined signal applied to the receiver. The large receiver drive levels that would occur from attempting to cancel the jaw motions would cause high battery current drain (made even worse because at subsonic frequencies the receiver impedance essentially equals the receiver DC resistance—its minimum value), even discounting the likely receiver/output stage saturation and attendant artifacts.

In addition to the previously mentioned use of a receiver shelf frequency, a knowledge of acoustical vent characteristics as relates to vent damping and transition from second to first order frequency response (zero location or transition frequency) may be used to improve the behaviour of the acoustic feedback loop which comprises the acoustical vent and reduce the previously named low frequency peaking, the peaking of the frequency response of the hearing aid in a low frequency region below speech frequencies such as below 100 Hz.

According to other embodiments, high pass characteristics of a frequency response of the acoustical vent comprises a transition frequency situated in a frequency range below the high pass cut-off frequency of the acoustical vent. The transition frequency (zero location) is separating a first order frequency response roll-off at frequencies below the transition frequency and second order frequency response roll-off at frequencies above the transition frequency. The transition frequency is situated in vicinity of a lower cut-off frequency of a frequency response of the canal microphone such as between 3 octaves below and 3 octaves above or 1 octave below and 1 octave above the lower cut-off frequency of the frequency response of the ear canal microphone. This embodiment is useful in minimizing phase shift in the frequency region below the high pass cut-off frequency of the acoustical vent so as to minimize the low frequency peaking of the closed loop frequency response of the hearing aid in that frequency region.

The lower cut-off frequency of the canal microphone may form ideally a first order high pass function and can be used as the previously mentioned additional low frequency roll-off in the defined subsonic filtering to achieve the desired total subsonic attenuation, and this is a key component of at least one embodiment. An alternative embodiment of the additional low frequency roll-off may take the form of an analog electrical or digital first order high pass function. However, at least one embodiment uses the barometric relief hole of the microphone diaphragm to perform an acoustic first order high pass function. Other high pass functions may exist in the system without significant impact on system performance if the associated cut-off frequencies are significantly lower than the cut-off frequency of the additional low frequency roll-off thus adding little additional phase shift at the frequency of low frequency peaking. The advantage to using the acoustic first order high pass function of the canal microphone lies in the dramatic increase in the maximum acoustic input level that the canal microphone can tolerate, which would greatly reduce the potential for intermodulation distortion between subsonic ear canal signals and speech or other desired audio frequency signals that could occur if the canal microphone exhibits significant nonlinearities at the very high signal levels possible in the occluded ear canal.

In an embodiment, the occlusion suppressor comprises a feedback path receiving and filtering the ear canal signal with a predetermined feedback transfer function to produce the occlusion suppression signal. By adjusting or tailoring the transfer function of the feedback path to certain features of the frequency response of the hearing aid, the provision of undesirable gain at one or more frequencies in the feedback transfer function may be reduced or avoided. This is useful for suppressing pronounced peaks in the frequency response of the hearing aid such as frequency response peaks caused by high frequency resonances of the receiver and/or other acoustical components of the hearing aid at or above 1 kHz such as between a frequency range between 1 kHz and 12 kHz. Therefore, undesired amplification of canal microphone noise within the 1-12 kHz frequency range, in which a considerable portion is very important for the understanding of speech, can be avoided or reduced.

In an embodiment, the predetermined feedback transfer function comprises a frequency selective filter having predetermined transfer function characteristics. The predetermined transfer function characteristics of the frequency selective filter may be configured to compensate for a frequency response peak of a frequency response of the hearing aid. In one such embodiment, the frequency selective filter may comprise a notch filter having a predetermined centre frequency and a predetermined bandwidth. The predetermined centre frequency and bandwidth of the notch filter may be advantageously tailored to compensate for the above-mentioned frequency response peaks caused by high frequency resonances of the receiver and/or acoustical system in the 1-12 kHz frequency response range. The compensation is nominally made by setting the predetermined centre frequency of the notch filter substantially equal to a peak frequency of the frequency response peak. Additionally, the predetermined bandwidth of the notch filter may be set essentially equal to a bandwidth of the frequency response peak in question. Adjustments to the nominal filter settings are made to minimize the positive gain peaks of the closed acoustic feedback loop relative to the open loop condition. Naturally, the predetermined feedback transfer function may comprise a plurality of frequency selective filters of the same type or of different types such as any combination of highpass filters, lowpass filters, bandpass filters, shelf filters and notch filters. In one embodiment, the predetermined feedback transfer function comprises 2, 3 or even more separate notch filters, having respective predetermined centre frequencies and bandwidths arranged to compensate for respective ones of a plurality of different frequency response peaks of the frequency response of the hearing aid.

In an embodiment, the occlusion processor is adapted to receive and store filter parameters associated with the predetermined transfer function characteristics of the frequency selective filter or respective filter parameters associated with the transfer function characteristics of a plurality of frequency selective filters. According to one embodiment, wherein the occlusion suppressor comprises the above-mentioned hard-wired or programmable Digital Signal Processor, the filter parameters may be stored as binary coefficients or numbers in a predetermined address range of a non-volatile memory accessible to the Digital Signal Processor. The occlusion processor may be adapted to receive and store the filter parameters associated with the predetermined transfer function characteristics of the frequency selective filter during a fitting procedure of the hearing aid. During the fitting procedure, the occlusion suppressor may be directly or indirectly coupled to a fitting computer through a wired or wireless communication channel. The occlusion processor may comprise, or be connected to, a data interface complying with a data transmission protocol of the wired or wireless communication channel allowing the occlusion processor to receive the filter parameters. The occlusion processor or the hearing loss processor may be configured to write these filter parameters to a predetermined address space or range of the non-volatile memory. Alternatively, the fitting computer may be adapted to directly connect to, access, and write the filter parameters to the predetermined address space or range in the non-volatile memory for subsequent read out by the occlusion processor or the hearing loss processor. Appropriate filter parameters may be determined by the fitting system or computer through an open-loop and/or closed loop measurement of the transfer function of the hearing aid when mounted in the user's ear. This transfer function is generally complex and involves contributions from the electrical and acoustical couplings between ambient microphone, hearing loss processor, occlusion suppressor, output amplifier, receiver, vent, ear canal and the user's tympanic membrane. An acoustical analysis of this transfer function will typically show a multitude of resonance frequencies, and their spectral positions will define acoustical system stability and the system performance.

In an embodiment, the subsonic filtering scheme may be contained in the acoustic feedback loop. In a further embodiment, the acoustic feedback loop may comprise a receiver 110, an ear canal microphone 109, an occlusion suppressor 106, an earmold vent 112, and a signal combiner 108. In an additional embodiment, the subsonic filtering scheme may be incorporated into one or more of the receiver 110, the ear canal microphone 109, the occlusion suppressor 106, an earmold vent 112, and the signal combiner 108. In an embodiment, the subsonic filtering scheme may be a separate function of the acoustic feedback loop.

In accordance with some embodiments, a hearing aid includes an ambient microphone configured to receive and convert environmental sound into an electronic input signal, a hearing loss processor configured to compensate the electronic input signal in accordance with a hearing loss of a user of the hearing aid, and to generate an electronic output signal, a receiver, an ear canal microphone configured for converting ear canal sound pressure including subsonic energy into an ear canal signal, an occlusion suppressor connected for reception and processing of the ear canal signal, and for transmitting an occlusion suppression signal, a signal combiner configured for combining the occlusion suppression signal and the electronic output signal to form a combined signal, and for transmitting the combined signal to the receiver, and a subsonic filter for filtering subsonic energy, wherein the receiver is configured to receive the combined signal, and convert the combined signal into an acoustic output signal, and wherein the receiver has a low frequency response with a lower cut-off frequency less than 10 Hz, or is capable of holding a static pressure in a sealed volume and having a rear cavity pressure equalization path to atmospheric pressure.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1:
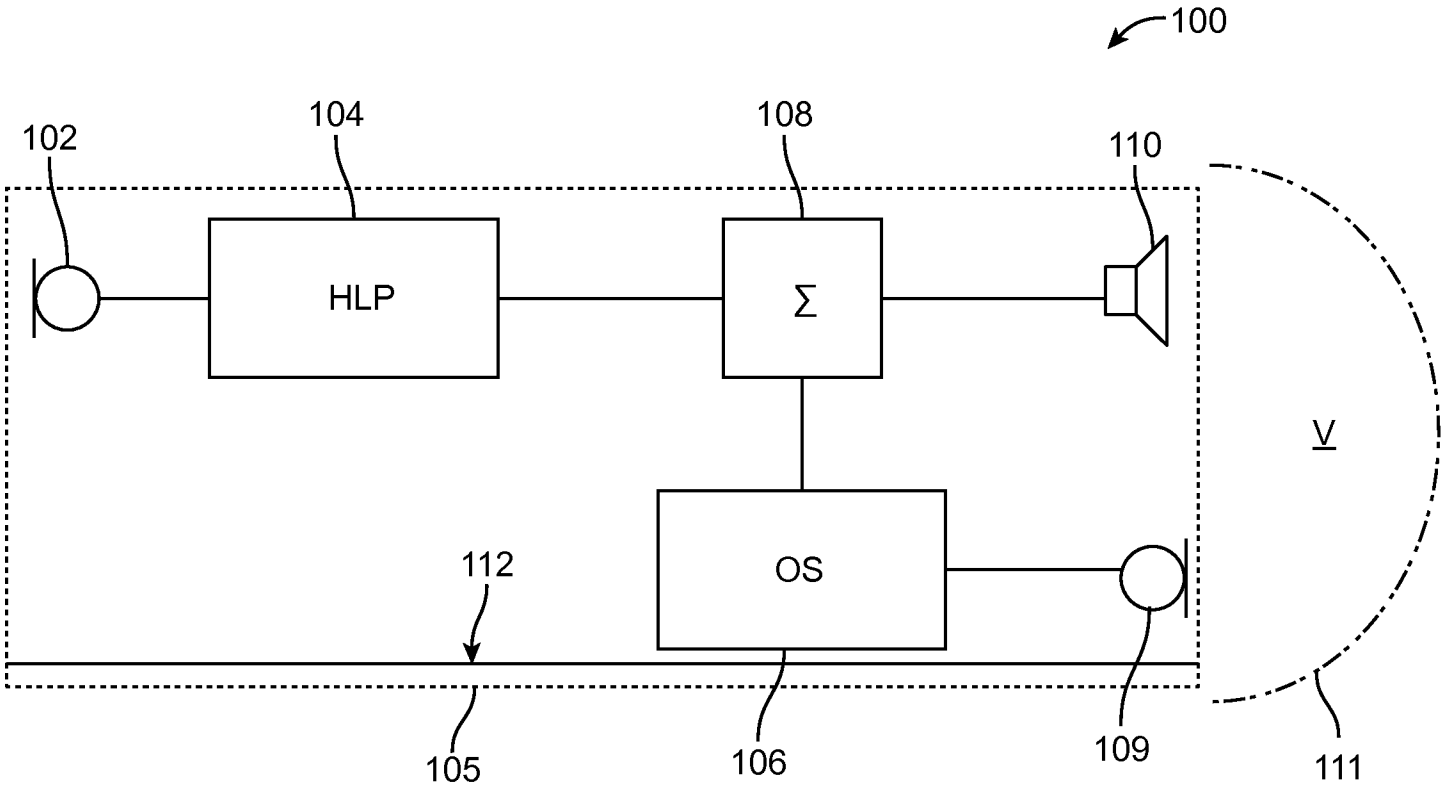
FIG. 1 shows a simplified schematic drawing of an experimental hearing aid with occlusion suppression in accordance with some embodiments.

Various embodiments are described hereinafter with reference to the figures.

It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

The experimental hearing aid 100 depicted on FIG. 1 comprises a hearing aid housing 105 which may comprise a custom made hard acrylic shell sized and shaped to fit a user's ear canal. An ambient microphone 102 may be situated in a proximate portion of the hearing aid housing 105 with a sound inlet (not shown) arranged in an outwardly oriented face or faceplate of the housing 105. The sound inlet conveys sound pressure or sound from the environment surrounding the user to the ambient microphone 102 so as to generate an electronic input or microphone signal representative of received sound. The electronic microphone signal is transmitted to a hearing loss processor 104 operatively coupled to the ambient microphone 102. In the present embodiment, the hearing loss processor 104 comprises a programmable low power Digital Signal Processor (DSP). The electronic microphone signal is provided in digital format for example by an oversampled ND converter positioned inside a housing of the ambient microphone 102 or as an integral part of hearing loss processor 104.

The hearing loss processor 104 is adapted to compensate the electronic input signal in accordance with a determined hearing loss of the user and generate a corresponding electronic output signal which is supplied to a signal combiner 108. In the present embodiment, the signal combiner 108 is embodied as a signal subtractor adapted for subtracting the electronic output signal and an occlusion suppression signal supplied by the occlusion suppressor 106. The occlusion suppression signal is derived from an ear canal signal generated by an ear canal microphone 109 in response to detected ear canal sound pressure within a fully or partly occluded ear canal volume, V, 111 in front of the user's tympanic membrane. The ear canal microphone 109 may be arranged in a distal portion of the hearing aid housing 105 and with a sound inlet extending through a tip portion of the hearing aid housing 105 to sense the ear canal sound pressure inside the ear canal volume 111. As previously explained, during normal use of the hearing aid 100, the ear canal sound pressure detected by the ear canal microphone 109 will be a superposition of body conducted sound and receiver emitted/generated sound. A passive acoustical vent 112, comprising an acoustical channel or channels extending through the hearing aid housing or extending through the ear mould may be blocked as required to explain certain problems or left open as used in an embodiment.

A receiver 110, such as a miniature balanced armature receiver, is adapted to receive and convert a combined signal supplied at an output of the subtractor 108 into an acoustic output signal. The receiver 110 has an extended low frequency response or static pressure capability to improve suppression of occlusion sound pressures within the fully or partly occluded ear canal volume 111. In the present embodiment, a lower cut-off frequency of a frequency response of the receiver is set to about 2 Hz or lower. However, in other embodiments, the lower cut-off frequency may be set to a value less than 10 Hz, such as less than 5 Hz or in another embodiment less than 1 Hz, or in yet another embodiment, the receiver may be substantially capable of holding a static pressure into a sealed volume, and having a rear cavity pressure equalization path to atmospheric pressure.

Figure 2:
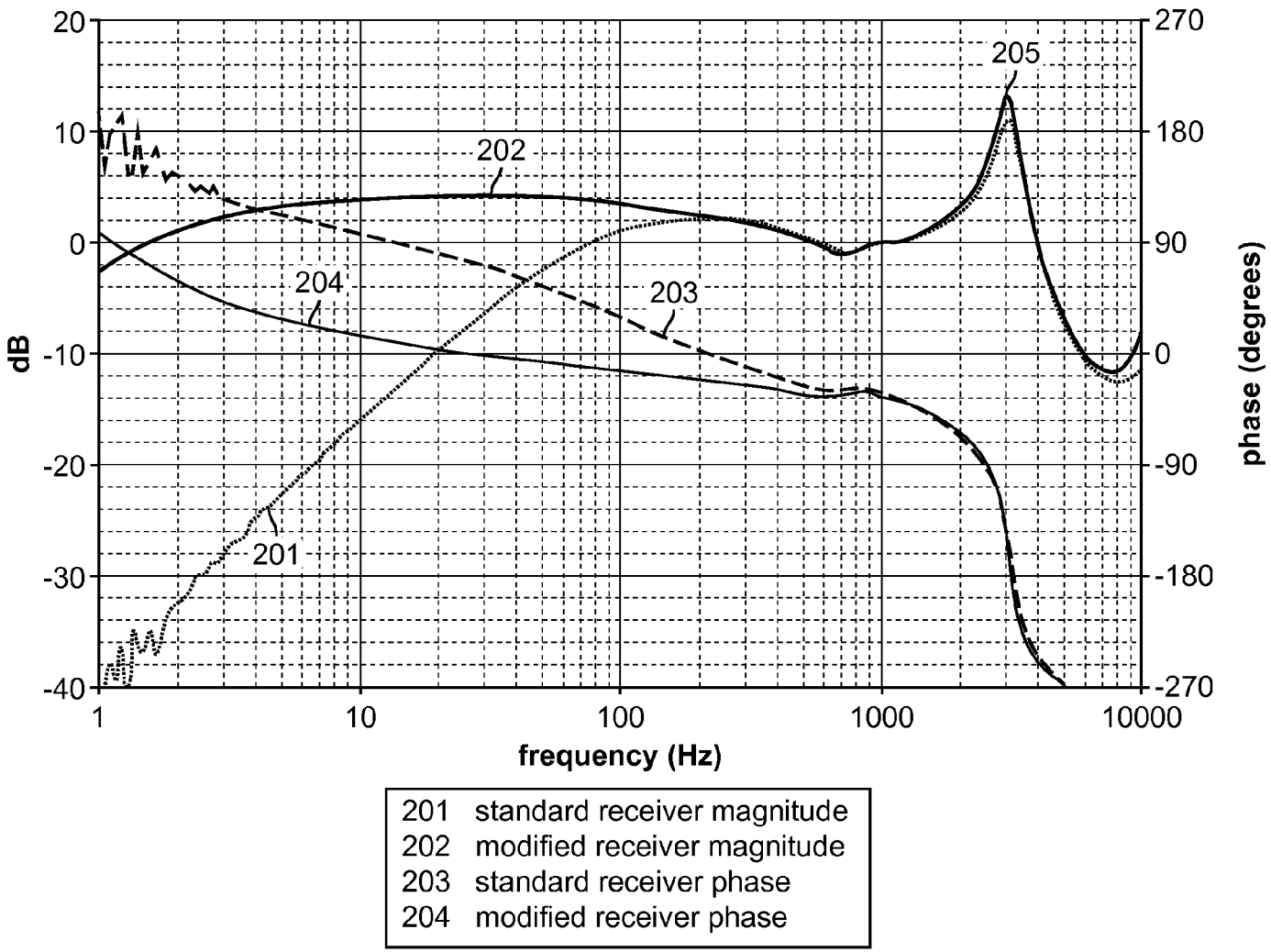
FIG. 2 depicts frequency response measurements on a standard receiver and a receiver with static pressure capability into a sealed unvented cavity and rear cavity pressure equalization path to atmospheric pressure used in the experimental hearing aid depicted on FIG. 1.

FIG. 2 depicts frequency response measurements on two different receivers used in the experimental hearing aid depicted on FIG. 1 with the vent 112 intentionally blocked. The frequency response curve (201 amplitude, 203 phase) was obtained from a standard receiver having a lower cut-off frequency of about 50 Hz as evident by comparing the recorded 1 kHz sound pressure level to the sound pressure level at 50 Hz. The frequency response curve (202 amplitude, 204 phase) was on the other hand measured on a specially modified balanced armature receiver with capability of holding a static pressure into a sealed volume, and having a rear cavity pressure equalization path to atmospheric pressure. Due to measurement system limitations a lower cut-off frequency of about 2 Hz is visible as illustrated.

The experimental hearing aid 100, corresponding to the simplified schematic diagram of FIG. 1, was evaluated experimentally with the vent 112 intentionally blocked on an acoustical coupler in three different configurations:

1) In a first exemplary configuration with a receiver with a normal lower cut-off frequency as illustrated on frequency response curve 201 of FIG. 2.

2) In a second exemplary configuration with a receiver with a normal lower cut-off frequency as illustrated on frequency response curve 201 of FIG. 2 and with a notch filter inserted in a feedback path of the occlusion suppressor 106.

3) In a third exemplary configuration with a receiver with the static pressure capability as illustrated on frequency response curve 202 of FIG. 2 and with the notch filter inserted in the feedback path of the occlusion suppressor 106.

In configurations 2) and 3) above, the feedback path is operative to receiving and filtering the ear canal signal supplied by the ear canal microphone with a feedback transfer function at least partly determined by the notch filter. The notch filter has a predetermined centre frequency and a predetermined bandwidth set or configured to compensate for a pronounced frequency response peak 205 of the frequency response of the hearing aid. In the present case, this frequency response peak 205 is largely determined by a mechanical/acoustical resonance of the receiver (110 of FIG. 1) at about 3 kHz but in other embodiments, frequency response peaks may be caused by various acoustical, mechanical or electrical circuits of an electrical or acoustical signal transmission path of the hearing aid.

Figure 3:
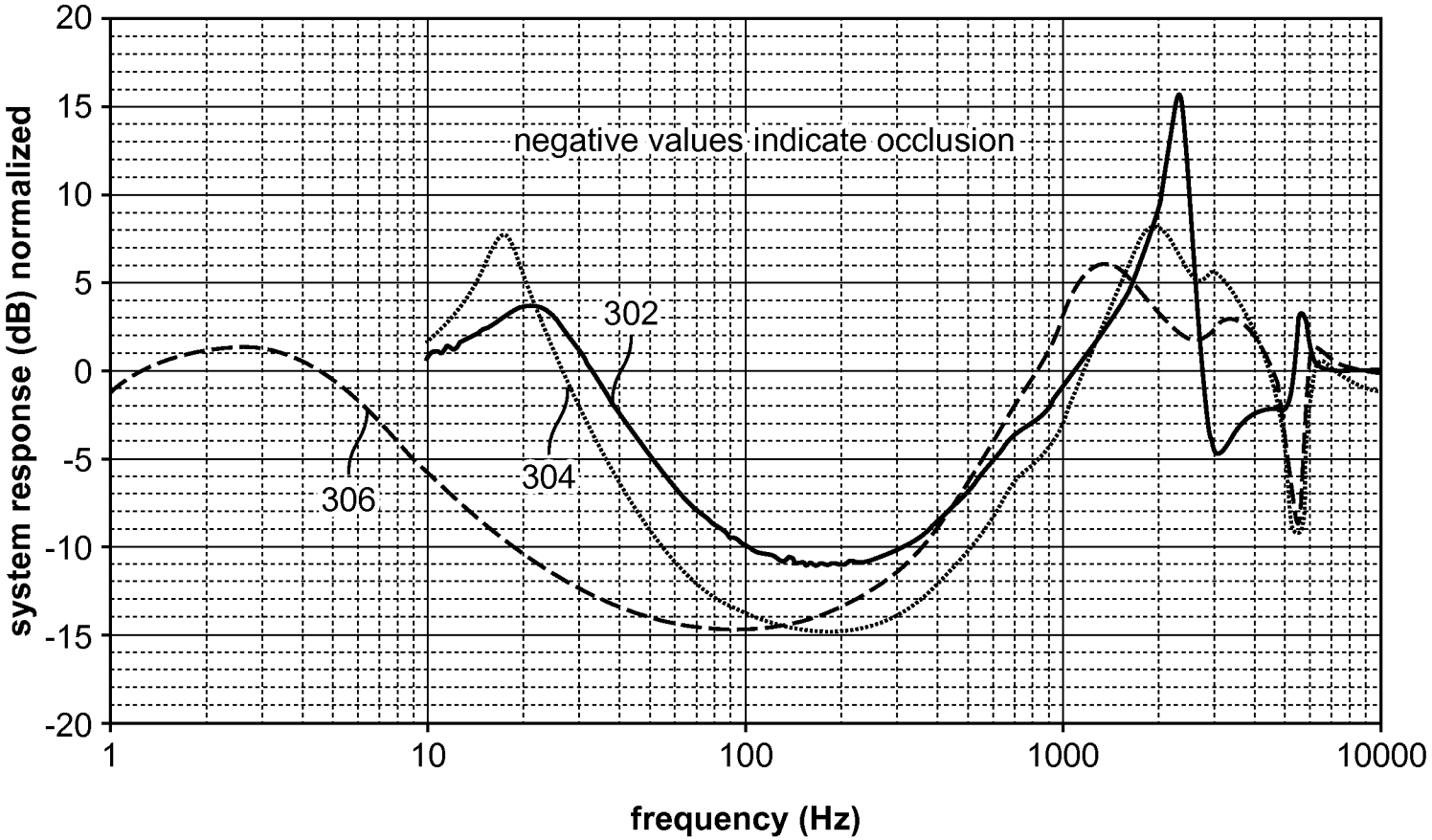
FIG. 3 shows measured occlusion suppression values versus frequency for the experimental hearing aid depicted on FIG. 1 with the two different receivers tested on FIG. 2, and illustrates the low frequency peaking.

The results of the evaluation are summarized in FIG. 3 which shows measured occlusion suppression in dB versus frequency for each of the three different configurations outlined above. The 0 dB line indicates no change of the measured level of the occlusion sound pressure within the user's ear canal by the action of the occlusion suppression system. A positive or negative reading reflects a higher or lower occlusion sound pressure, respectively.

The hearing aid with the standard receiver corresponding to configuration 1) above obtains approximately 9-11 dB of cancellation in a frequency range between 100 Hz and 300 Hz as indicated by curve 302. However, an undesired lack of occlusion suppression takes place at lower and higher frequencies such as below 25 Hz and above 1 kHz, in particular in vicinity of the response peak 205, where the occlusion sound pressure increases to a level higher than the unassisted case.

The hearing aid with the standard receiver and the notch filter in the feedback path, corresponding to configuration 2) above, obtains approximately 13-15 dB of cancellation in a frequency range between 100 Hz and 300 Hz as indicated by the dotted curve 304. Furthermore, occlusion suppression in vicinity of the response peak 205 has been significantly improved by about 6-8 dB. However, an undesired lack of occlusion suppression "low frequency peaking" remains at lower frequencies such as below 25 Hz as illustrated by dotted curve 304.

The hearing aid configuration with the receiver with extended low frequency response or static pressure capability, i.e. corresponding to configuration 3) above, obtains much improved occlusion suppression or attenuation in the entire low-frequency response range of the present experimental hearing aid. A dramatic improvement in occlusion suppression of about 8-15 dB in a frequency range between 10 Hz and 25 Hz and 3 dB up to 50 Hz is readily observable as illustrated by dashed curve 306, compared to configuration 2) above, "low frequency peaking" remains very low at lower frequencies such as in the subsonic region from 1 to 5 Hz as illustrated by dashed curve 306.

While this would seem to be acceptable performance, as explained in the background, the system in FIG. 1 as tested with vent 112 blocked still suffers from subsonic overload predominantly caused by jaw motion.

The loop still tries to cancel these very low frequencies, due to the fact that the loop gain is now much higher at these frequencies. Therefore, loop gain must be reduced at very low subsonic frequencies where jaw motion creates large amplitudes in the sealed canal to the point that no significant attempt to cancel the jaw motion subsonic signal occurs.

Figure 4:
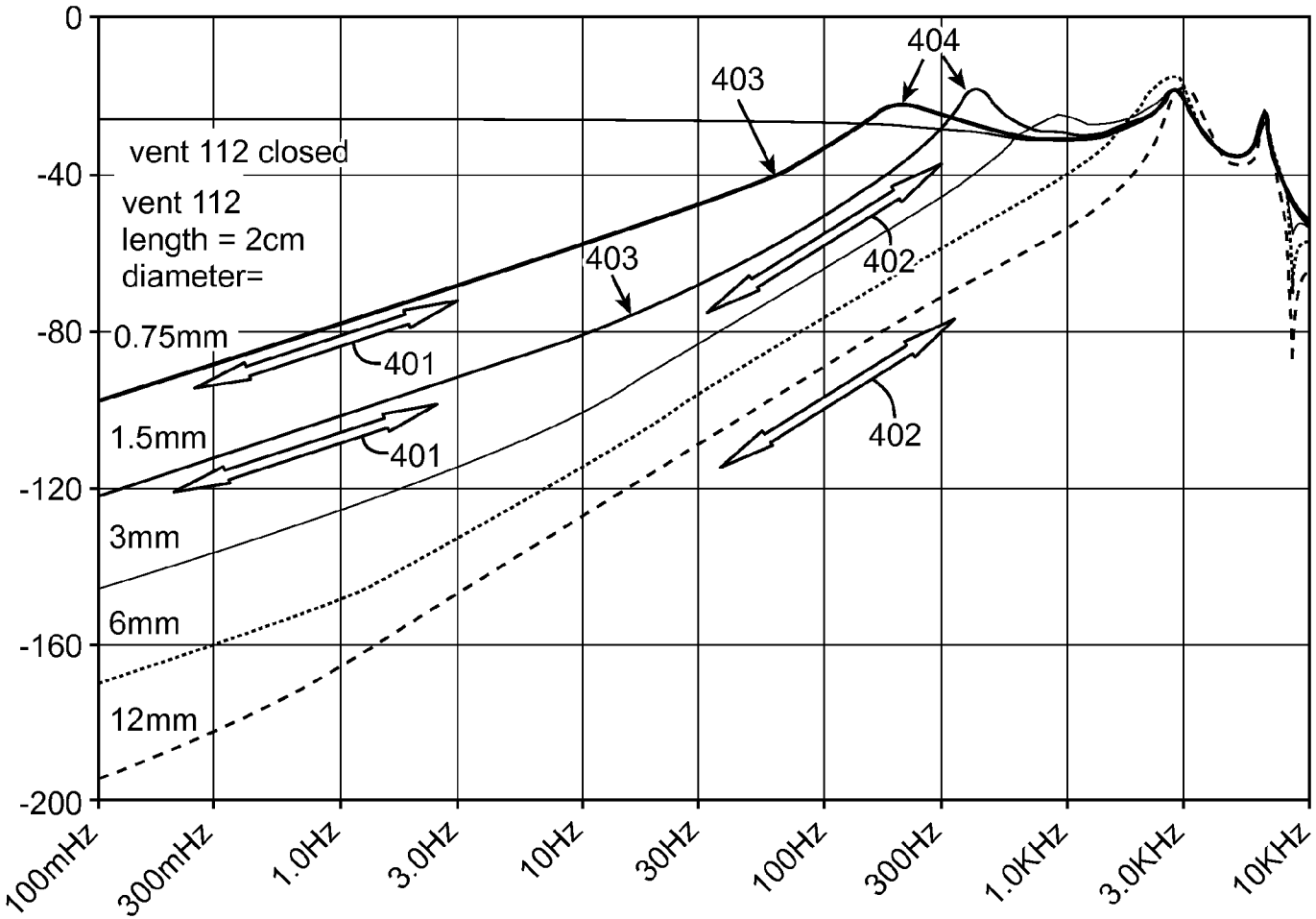
FIG. 4 shows vent simulation results demonstrating the vent transition frequency and the subsonic attenuation available for different diameter vents as used in an embodiment.

The vent 112 when left open as in one embodiment performs a large portion of the required subsonic attenuation and has a frequency response as shown in the simulation results for various vent dimensions in FIG. 4 The response curves have 2 slope regions: regions 401 being the 6 dB/octave slope region and regions 402 being the 12 dB/octave slope region. The "transition frequency" 403 is the dividing point between these two regions. The cut-off frequency of the vent 404 corresponds to the low frequency peak at the higher frequency end of the 12 dB/octave slope region.

Figure 5:
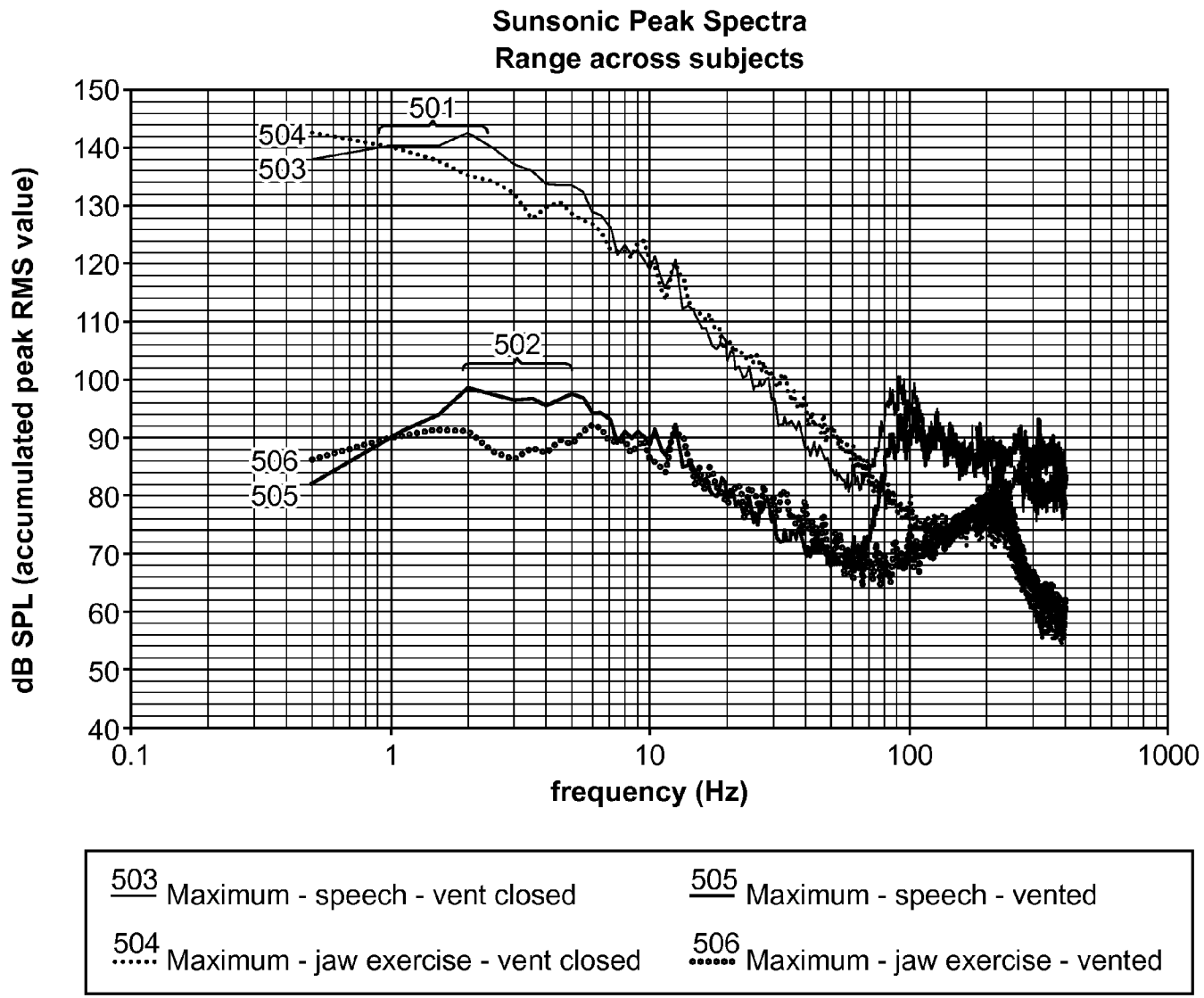
FIG. 5 shows the measured sound pressure levels generated in the occluded ear canal by jaw motions for both the unvented condition as well as the vented condition using vents with a nominal 200 to 300 Hz low frequency cut-off.

The measured sound pressure levels generated in the occluded ear canal by jaw motions are shown in FIG. 5 for both the unvented condition (curve 503—while speaking, curve 504—during silent jaw motion exercise) as well as the vented condition (curve 505—while speaking, curve 506—during silent jaw motion exercise) using vents with a nominal 200 to 300 Hz low frequency cut-off, with the result that levels can reach the 140 dB SPL mark in the 1-2 Hz region (region 501), and can reach nearly 100 dBSPL in the 2-5 Hz region when vented (region 502).

Figure 6:
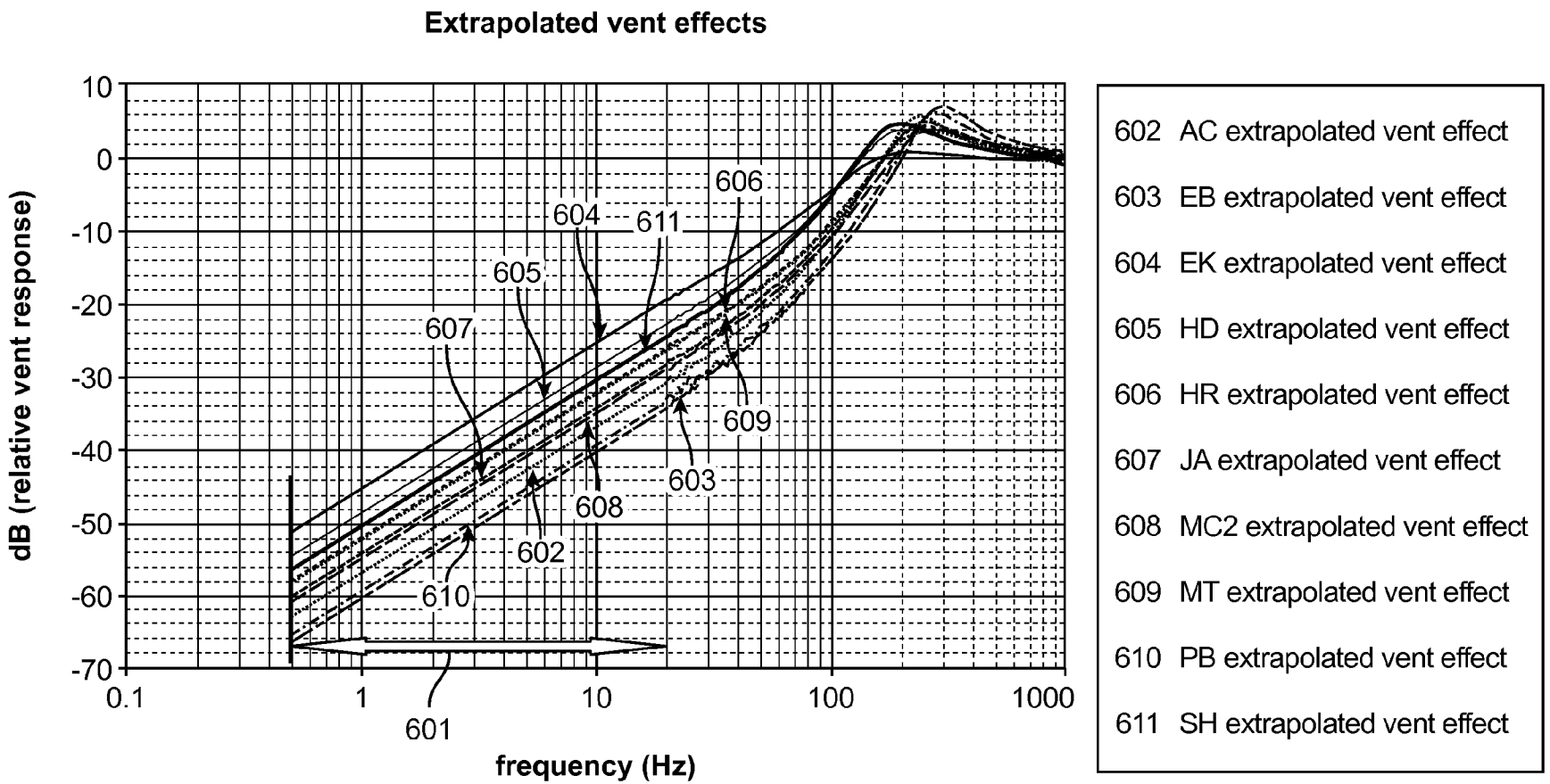
FIG. 6 shows the measured low frequency response of vents, with the subsonic region below 20 Hz extrapolated at 6 dB/octave from theory.

The measured low frequency response of vents (subject curves 602 through 611) is depicted in FIG. 6, with the subsonic region below 20 Hz extrapolated (region 601) at 6 dB/octave from theory to clean up the subsonic acoustic noise which was present in the measurement environment. Note that with the nominal 1 mm vent size used (which produced 200 to 300 Hz cut-off frequencies) that the transition frequency is sufficiently above 20 Hz to allow this to be reasonably accurate.

Figure 7:
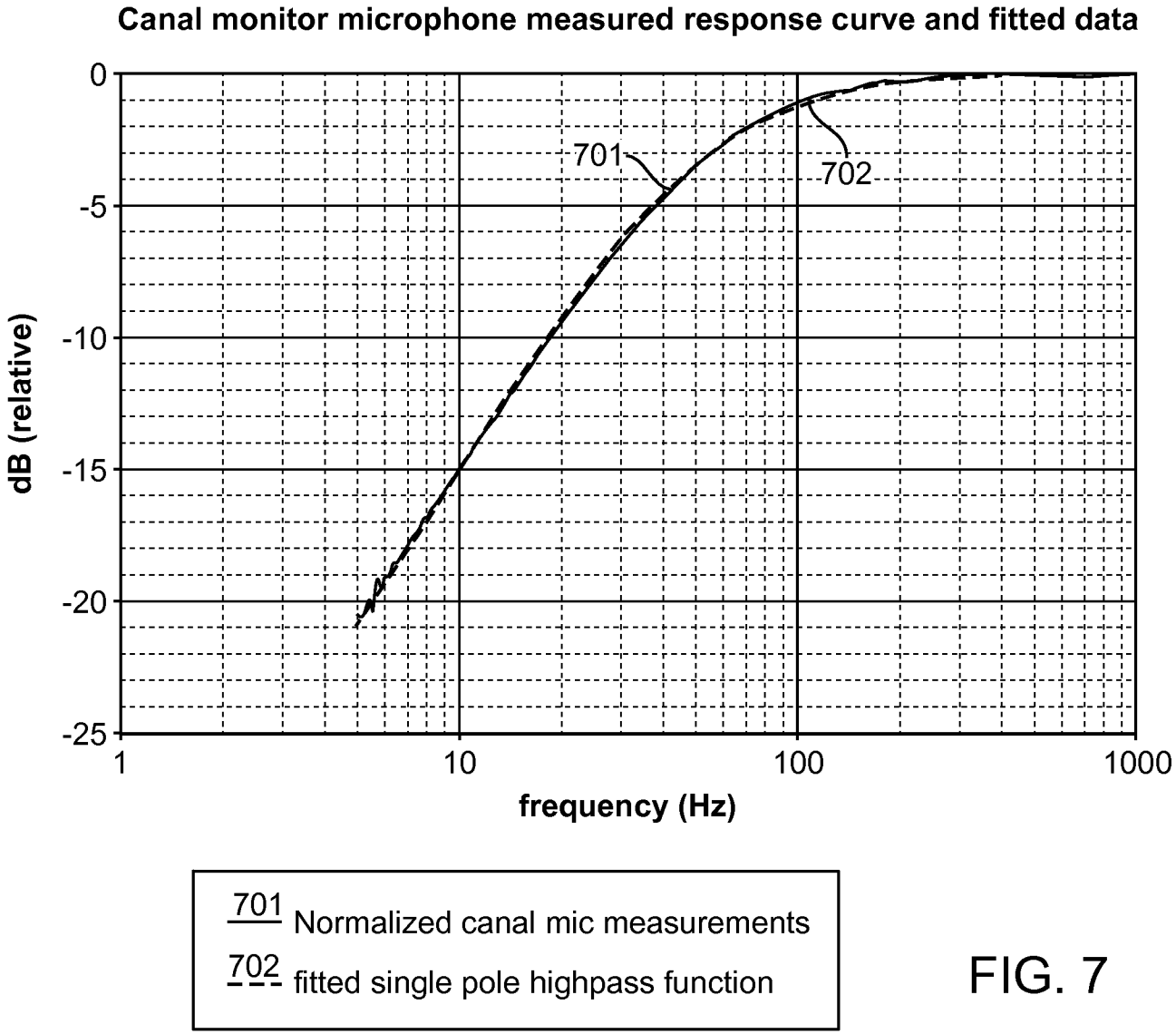
FIG. 7 depicts the measured low frequency response of the ear canal microphone overlaid with a single pole highpass function.

FIG. 7 depicts the measured low frequency response of the ear canal microphone (solid curve 701) overlaid with a simulated single pole highpass function (dashed curve 702) demonstrating the highly accurate first order acoustic highpass function of the ear canal microphone.

The lower cut-off frequency of the canal microphone may be designed to be a nearly ideal first order high pass function and can be used as the previously mentioned additional low frequency roll-off in the defined subsonic filtering to achieve the desired total subsonic attenuation, and this is a key component of our preferred embodiment. An alternative embodiment of the additional low frequency roll-off may take the form of an analog electrical or digital first order high pass function. However the preferred embodiment uses the barometric relief hole of the microphone diaphragm to perform an acoustic first order high pass function. Other high pass functions may exist in the system without significant impact on system performance if the associated cut-off frequencies are significantly lower than the cut-off frequency of the additional low frequency roll-off thus adding little additional phase shift at the frequency of low frequency peaking. The advantage to using the acoustic first order high pass function of the canal microphone lies in the dramatic increase in the maximum acoustic input level that the canal microphone can tolerate, which would greatly reduce the potential for intermodulation distortion between subsonic ear canal signals and speech or other desired audio frequency signals that could occur if the canal microphone exhibits significant nonlinearities at the very high signal levels possible in the occluded (but vented as proposed) ear canal.

Figure 8:
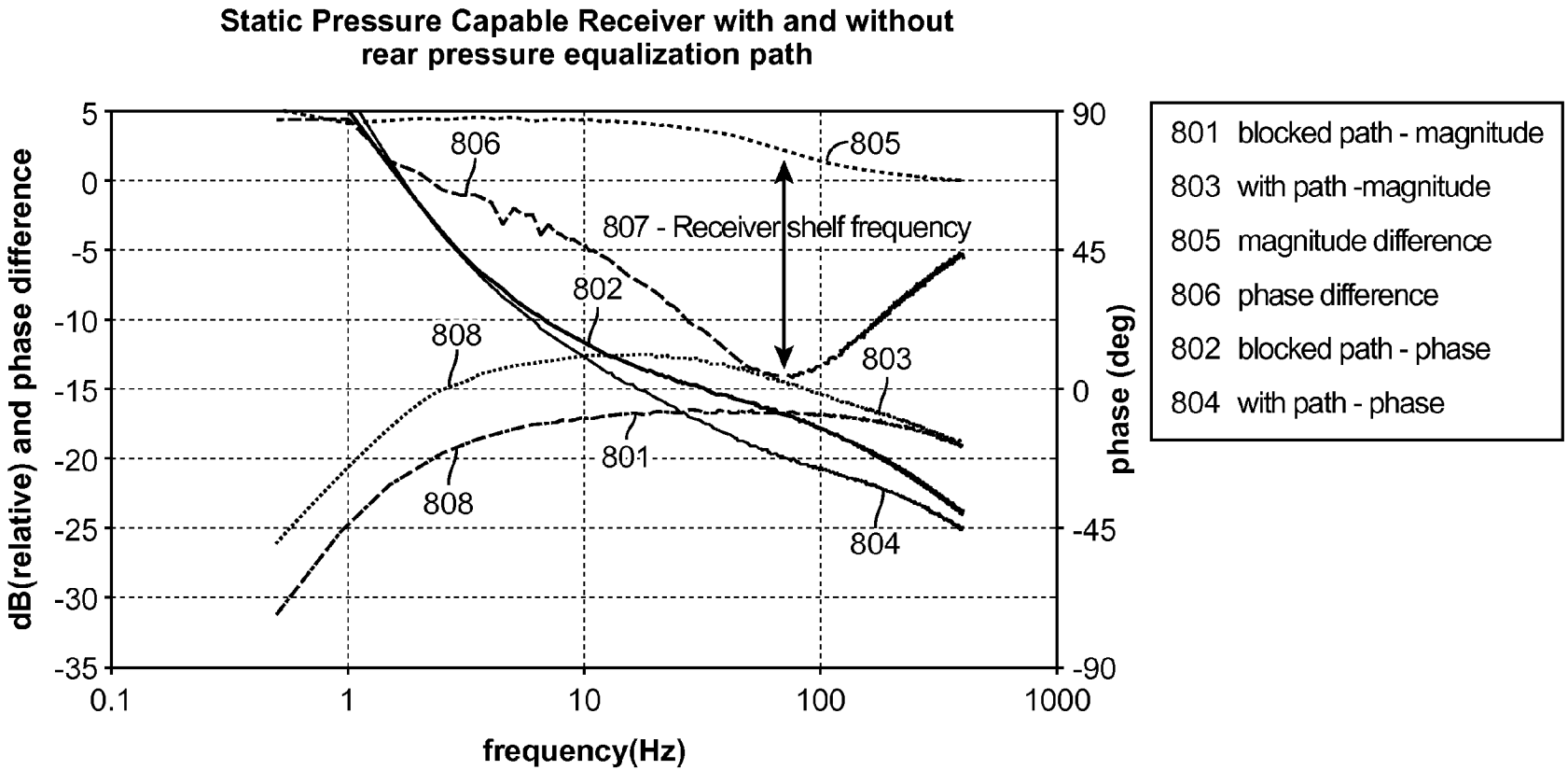
FIG. 8 shows the measured low frequency response of a static pressure capable receiver with and without rear pressure equalization path and demonstrating the "receiver shelf frequency".

FIG. 8 shows the measured low frequency response of a static pressure capable receiver without rear pressure equalization path, where said rear pressure equalization path allows the rear cavity to follow atmospheric pressure changes. (Blocking the pressure equalization path is not a practical operating condition but as a test condition allows us to demonstrate another characteristic of this receiver configuration.) (curve 801—amplitude, curve 802—phase) and with rear pressure equalization path (the normal operating condition) (curve 803—amplitude, curve 804—phase) and demonstrating the "receiver shelf response" (curve 805—amplitude, curve 806—phase) which is the receiver response of a static pressure capable receiver with rear pressure equalization path referenced to the receiver response of a static pressure capable receiver without rear pressure equalization path. Note the amplitude (curve 805) and phase (curve 806) differences between the two conditions. The shelf response characteristic has a boost of the lowest frequencies compared to the higher frequencies where no boost occurs. There is also a dip or minimum in the phase difference at the frequency corresponding to the mid amplitude point of the shelf boost. This frequency is referred to as the receiver "shelf frequency 807. Finally shown is the measurement system low frequency cut-off 808 at approximately 2 Hz, which prevents seeing the true subsonic response curve of the static pressure capable receiver, but which does not substantially affect the "receiver shelf response".

Figure 9:
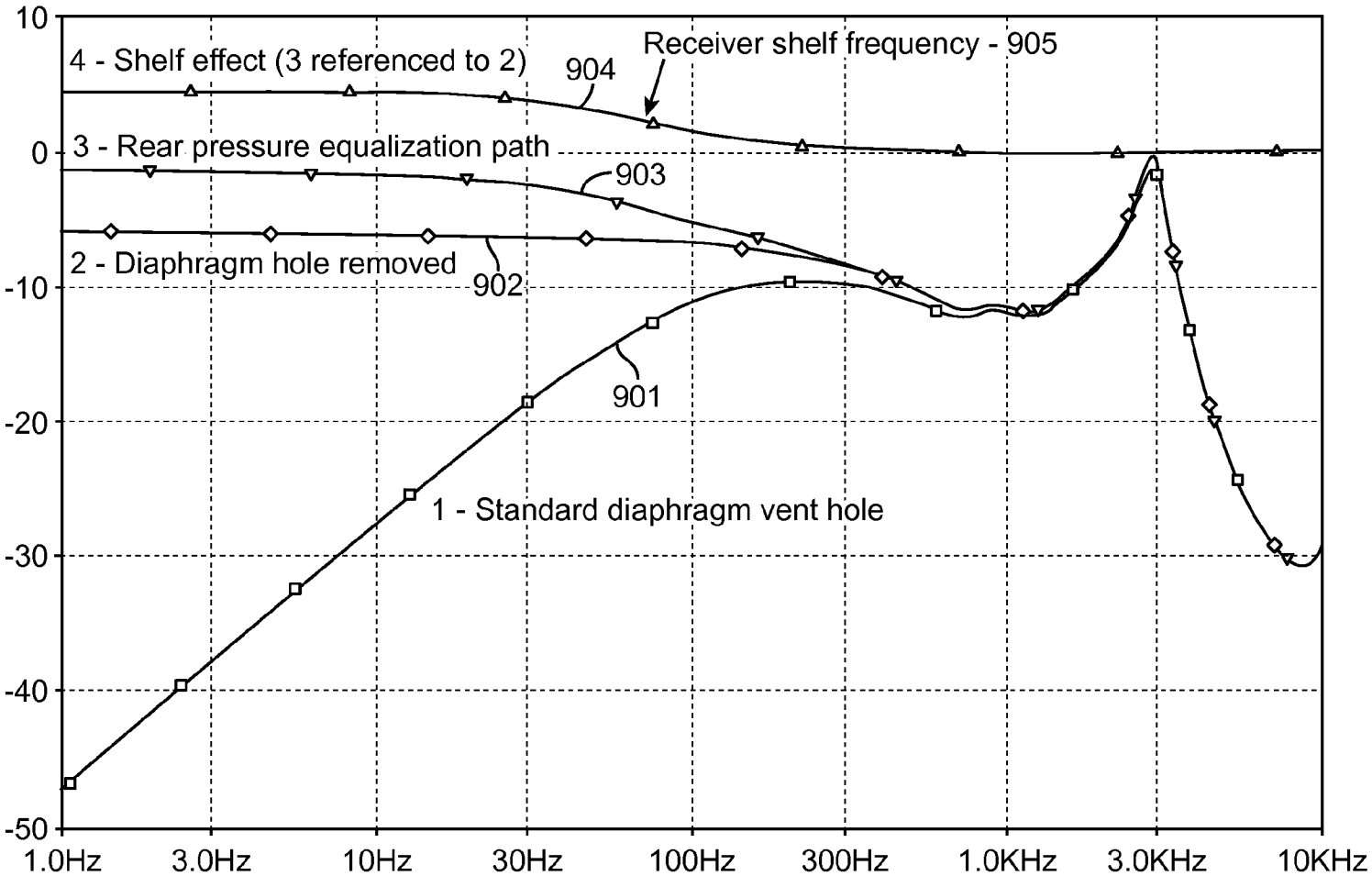
FIG. 9 shows the simulated amplitude response for a standard receiver and a static pressure capable receiver with and without rear pressure equalization path and demonstrating the "receiver shelf frequency".

FIG. 9 shows the simulated amplitude response for a standard receiver (curve 901) and a static pressure capable receiver (substantially capable of holding a static pressure into a sealed volume) with (curve 903) and without (curve 902) a rear pressure equalization path where said rear pressure equalization path allows the rear cavity to follow atmospheric pressure changes, and demonstrating the "receiver shelf response" (curve 904) and "receiver shelf frequency" 905. Unlike the measured responses of FIG. 8, the simulation is not limited by a low frequency cut-off such as measurement system low frequency cut-off 808, and therefore reveals the theoretically perfectly flat subsonic response curve (theoretical response to DC) of the static pressure capable receiver.

Figure 10:
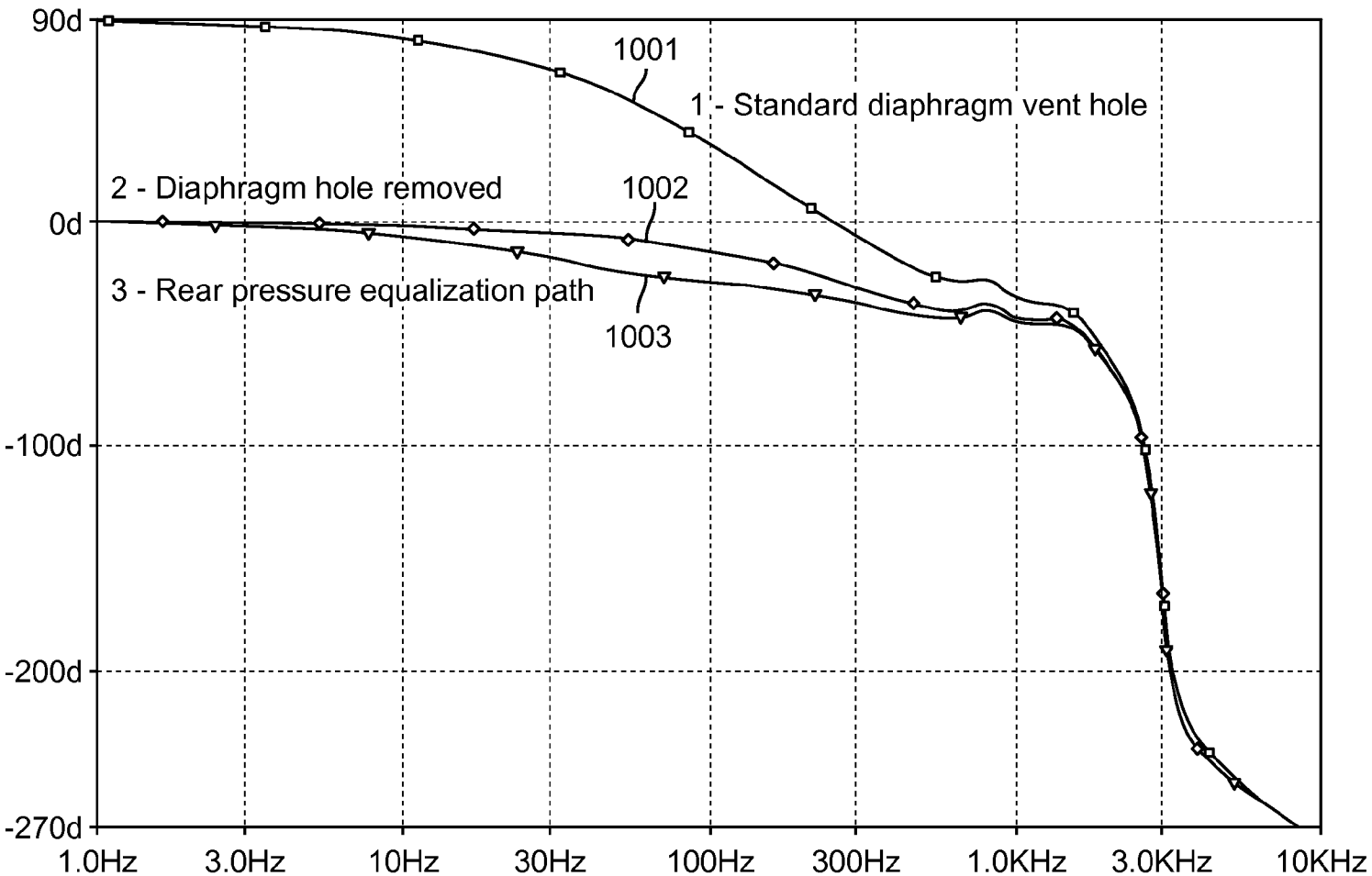
FIG. 10 shows the simulated phase response for a standard receiver and a static pressure capable receiver with and without a rear pressure equalization path.

FIG. 10 shows the simulated phase response for a standard receiver (curve 1001) and a static pressure capable receiver with (curve 1003) and without (curve 1002) a rear pressure equalization path.

Figure 11:
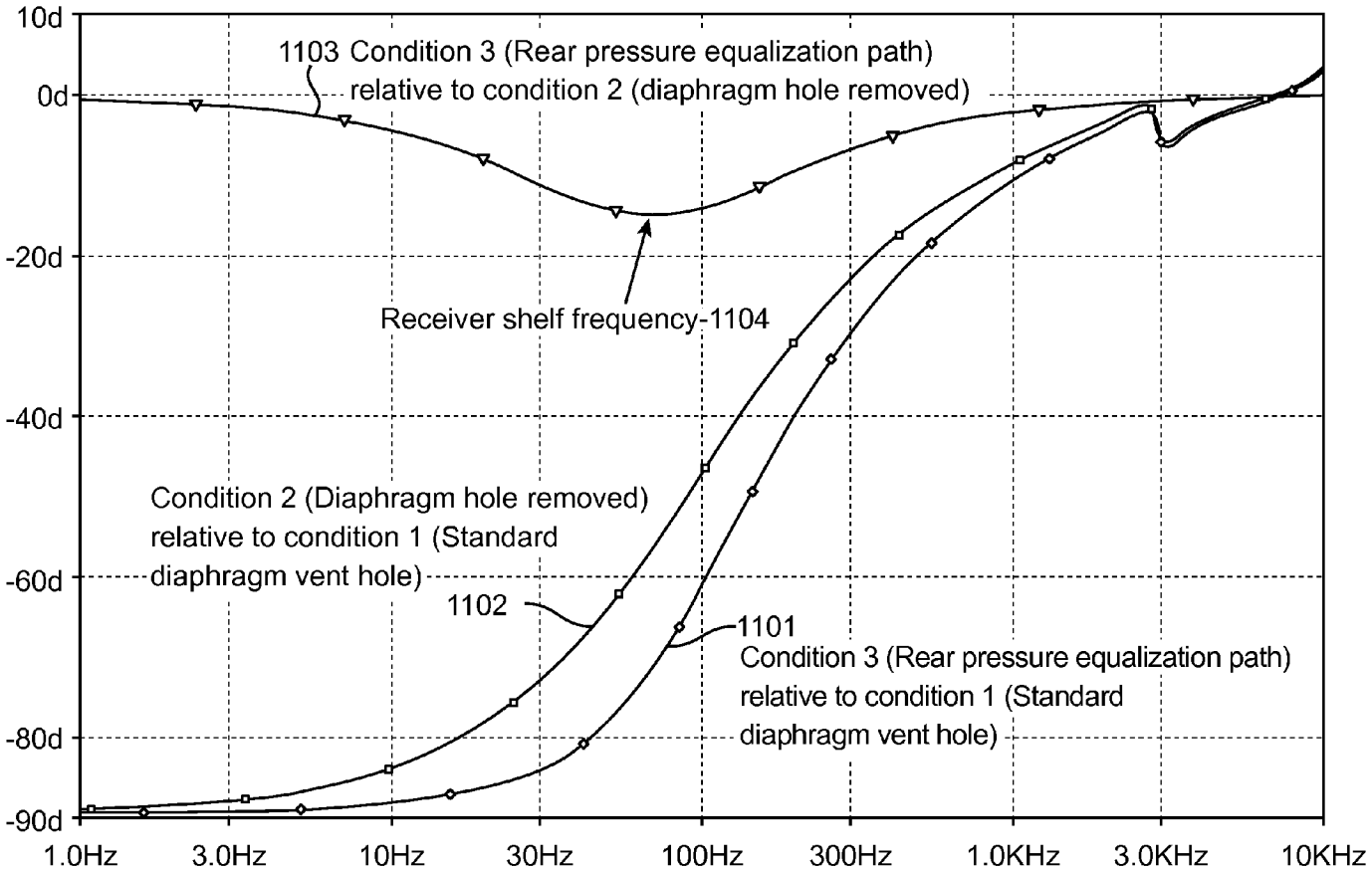
FIG. 11 shows the simulated relative phase response differences for a static pressure capable receiver referenced to a standard receiver with and without a rear pressure equalization path and demonstrating the "receiver shelf (phase) response" and the "receiver shelf frequency".

FIG. 11 shows the simulated relative phase response differences for a static pressure capable receiver referenced to a standard receiver with (curve 1101) and without (curve 1102) a rear pressure equalization path and demonstrating the "receiver shelf (phase) response" (curve 1103) and "receiver shelf frequency"—1104, demonstrating the advantageous dip in the relative phase response which may be used to reduce the amplitude of the "low frequency peaking".

Figure 12:
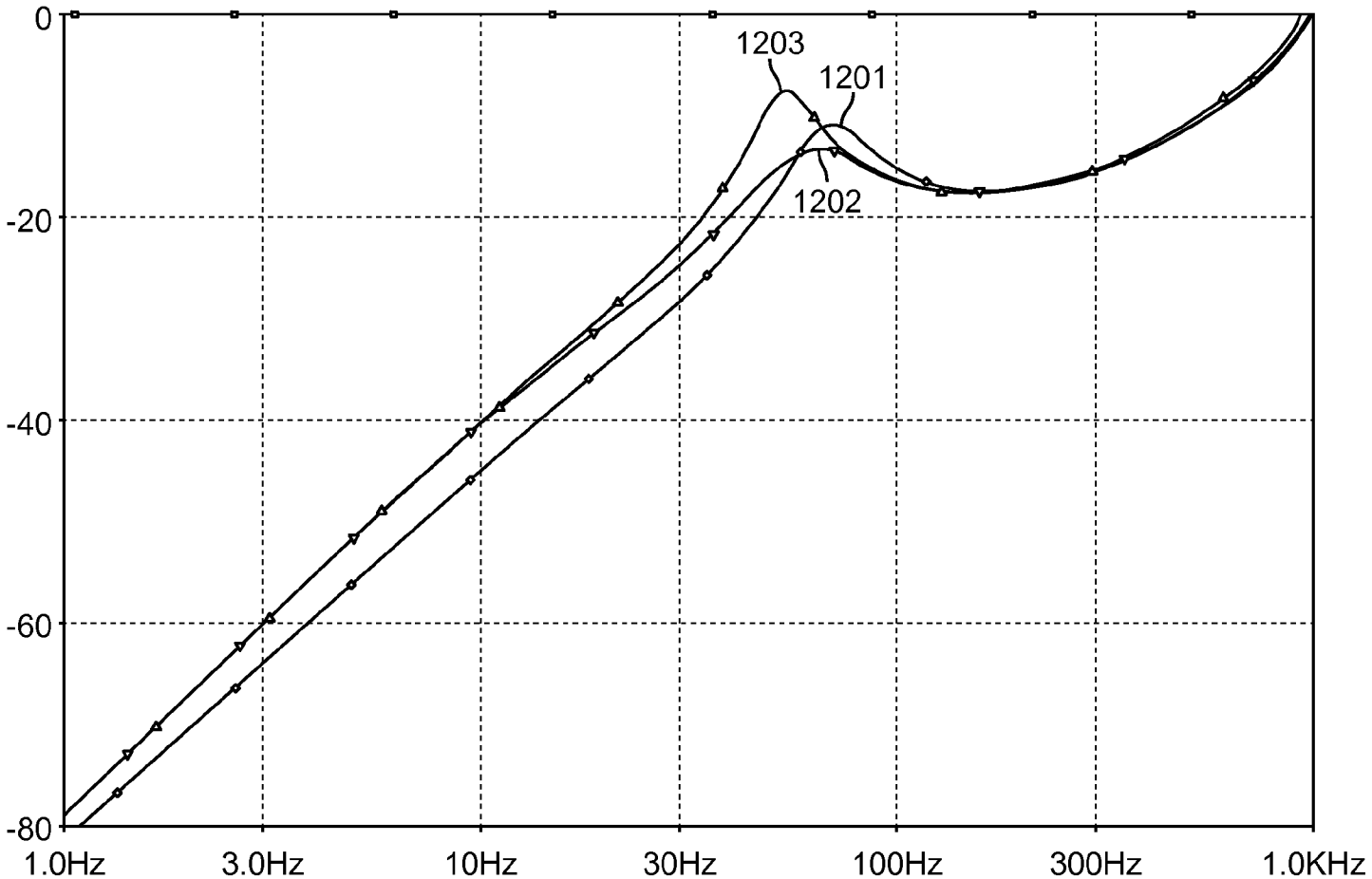
FIG. 12 shows the effects of tuning the receiver shelf frequency relative to the frequency of the "low frequency peaking"

FIG. 12 shows the effects of tuning the receiver shelf frequency relative to the frequency of the "low frequency peaking" on the closed loop response with active occlusion cancellation. The shelf frequencies chosen were 1 Hz, 40 Hz and 300 Hz. As seen, the frequency of the low frequency peaking is somewhat affected which is not of much consequence, but the amplitude of the "low frequency peaking" is affected, not very strongly, but the minimum condition is advantageous. The 1 Hz shelf frequency (curve 1201) corresponds effectively to almost closing the rear cavity pressure equalization path to atmospheric pressure or not having a shelf frequency. The 40 Hz shelf frequency (curve 1202) gives in this case an approximate minimum amplitude of the low frequency peaking. The 300 Hz shelf frequency (curve 1203) could be used for example to provide a slight receiver boost and possible maximum output capability of the receiver for the lowest speech frequencies, which would be advantageous, but at the cost of increased amplitude of the low frequency peaking.

Although particular embodiments have been shown and described, it will be understood that they are not intended to limit the claimed inventions, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

an ambient microphone configured to receive and convert environmental sound into an electronic input signal;

a hearing loss processor configured to compensate the electronic input signal in accordance with a hearing loss of a user of the hearing aid, and to generate an electronic output signal;

a receiver;

an ear canal microphone configured for converting ear canal sound pressure including subsonic energy into an ear canal signal;

an occlusion suppressor connected for reception and processing of the ear canal signal, and for transmitting an occlusion suppression signal;

a signal combiner configured for combining the occlusion suppression signal and the electronic output signal to form a combined signal, and for transmitting the combined signal to the receiver; and a subsonic filter for filtering subsonic energy;

wherein the receiver is configured to receive the combined signal, and convert the combined signal into an acoustic output signal; and wherein the receiver has a low frequency response with a lower cut-off frequency less than 10 Hz, or is capable of holding a static pressure in a sealed volume and having a rear cavity pressure equalization path to atmospheric pressure.

2. The hearing aid according to claim 1, wherein the receiver comprises a diaphragm with a diaphragm hole setting the lower cut-off frequency of the frequency response of the receiver.

3. The hearing aid according to claim 1, wherein the receiver comprises:

a diaphragm without a diaphragm hole; and a rear chamber vent;

wherein the receiver is substantially capable of holding a static pressure in a sealed volume.

4. The hearing aid according to claim 1, further comprising:

a housing or an ear mould; and an acoustical vent extending through, or around, the housing or the ear mould of the hearing aid, the acoustical vent having a high pass cut-off frequency between 100 Hz and 500 Hz or between 200 Hz and 300 Hz.

5. The hearing aid according to claim 4, wherein high pass characteristics of a frequency response of the acoustical vent comprises a transition frequency situated in a frequency range below the high pass cut-off frequency of the acoustical vent, and the transition frequency separating a first order frequency response roll-off at frequencies below the transition frequency and a second order frequency response roll-off at frequencies above the transition frequency.

6. The hearing aid according to claim 5, wherein the transition frequency is situated in a vicinity of a lower cut-off frequency of a frequency response of an additional frequency roll-off function.

7. The hearing aid according to claim 6, wherein the additional frequency roll-off function comprises an analog electrical or digital high pass function having substantially first order characteristics.

8. The hearing aid according to claim 6, wherein the additional frequency roll-off function comprises an acoustical or electrical high pass function included in the canal microphone, wherein the acoustical or electrical high pass function comprises substantially first order characteristics.

9. The hearing aid according to claim 6, wherein the transition frequency is situated between 3 octaves below and 3 octaves above, or 1 octave below and 1 octave above, the lower cut-off frequency of the frequency response of the additional frequency roll-off function.

10. The hearing aid according to claim 1, wherein the occlusion suppressor comprises a feedback path receiving and filtering the ear canal signal with a predetermined feedback transfer function to produce the occlusion suppression signal.

11. The hearing aid according to claim 10, wherein the predetermined feedback transfer function comprises a frequency selective filter having predetermined transfer function characteristics.

12. The hearing aid according to claim 11, wherein the frequency selective filter comprises a notch filter having a predetermined centre frequency and a predetermined bandwidth.

13. The hearing aid according to claim 11, wherein the occlusion suppressor is configured to receive and store filter parameters associated with the predetermined transfer function characteristics of the frequency selective filter.

14. The hearing aid according to claim 13, wherein the occlusion suppressor is configured to receive and store the filter parameters associated with the predetermined transfer function characteristics of the frequency selective filter during a fitting procedure.

15. The hearing aid according to claim 14, wherein the predetermined transfer function characteristics of the frequency selective filter are determined by a measurement procedure during the fitting procedure.

16. The hearing aid according to claim 11, wherein the predetermined transfer function characteristics of the frequency selective filter is configured to compensate for a frequency response peak of a frequency response of the hearing aid.

17. The hearing aid according to claim 1, further comprising a vent enabling fluid communication through the hearing aid, wherein the subsonic filter comprises a combination of the vent and a low frequency roll off in the frequency response of an acoustic feedback loop.

18. The hearing aid according to claim 17, wherein the low frequency roll-off comprises a first order highpass function.

19. The hearing aid according to claim 10, wherein a measured performance of the feedback path has a low frequency peak in a frequency region below 100 Hz, and wherein an amplitude of the low frequency peak is minimized.

20. The hearing aid according to claim 19, wherein the feedback path is a closed loop acoustic feedback path.

21. The hearing aid according to claim 20, further comprising a shelf filter within the closed loop acoustic feedback path, the shelf filter having a low frequency shelf response characteristic and a corresponding shelf frequency, wherein the shelf frequency is adjustable relative to a frequency of the low frequency peak to minimize the amplitude of the low frequency peak.

22. The hearing aid according to claim 1, wherein the receiver has a rear cavity pressure equalization path to atmospheric pressure.

23. The hearing aid according to claim 2, wherein the receiver comprises a rear cavity pressure equalization path to atmospheric pressure.

* * * * *